US007370449B1

(12) United States Patent
Beckmann

(10) Patent No.: US 7,370,449 B1
(45) Date of Patent: May 13, 2008

(54) MOUNTING DEVICES FOR FIREARMS AND METHODS OF OPERATING THE SAME

(75) Inventor: Rudi Beckmann, Wohnsitz (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 11/506,344

(22) Filed: Aug. 18, 2006

Related U.S. Application Data

(63) Continuation of application No. PCT/EP2005/001653, filed on Feb. 17, 2005.

(30) Foreign Application Priority Data

Feb. 19, 2004 (DE) ..... 10 2004 008 211

(51) Int. Cl.
*F41A 3/00* (2006.01)

(52) U.S. Cl. ..... 42/90; 42/106; 42/127; 24/542; 248/229.22

(58) Field of Classification Search ..... 42/90, 42/106, 124, 127; 24/455, 542, 568; 248/229.22, 248/226.11
See application file for complete search history.

(56) References Cited

U.S. PATENT DOCUMENTS

| | | | | |
|---|---|---|---|---|
| 4,580,362 | A * | 4/1986 | Stevens | 42/1.01 |
| 5,155,915 | A | 10/1992 | Repa | |
| 6,385,892 | B1 * | 5/2002 | Vendetti | 42/86 |
| 2006/0117636 | A1 * | 6/2006 | Newhall et al. | 42/124 |
| 2006/0207156 | A1 * | 9/2006 | Larue | 42/127 |
| 2006/0283070 | A1 * | 12/2006 | Murello | 42/127 |

FOREIGN PATENT DOCUMENTS

| | | | |
|---|---|---|---|
| BE | 678316 | A | 9/1996 |
| CA | 2036620 | A1 | 8/1991 |
| DE | 12 56 113 | B | 12/1967 |
| DE | 90 02 215 | U1 | 4/1990 |
| DE | 44 44 677 | C1 | 2/1996 |
| EP | 0444300 | A2 | 9/1991 |
| EP | 0717258 | A1 | 6/1996 |

OTHER PUBLICATIONS

Inernational Bureau, International Preliminary Report on Patentability, Aug. 31, 2006, 7 pages.
International Bureau, International Preliminary Report on Patentability, Oct. 12, 2006, 7 pages.

* cited by examiner

*Primary Examiner*—John W Eldred
(74) *Attorney, Agent, or Firm*—Hanley, Flight & Zimmerman, LLC

(57) ABSTRACT

Mounting devices for firearms and methods of mounting the same are disclosed. An example mounting device for use with a firearm includes a clamping device, with which the mounting device can be optionally clamped to the firearm. The clamping device includes a rigid clamping jaw arrangement, a movable clamping jaw arrangement opposite the rigid clamping jaw arrangement, and a swiveling lever. The swiveling lever is coupled to a spring device that locks the movable clamping jaw arrangement, and the spring device has a first spring arrangement, which loads the swiveling lever in an opening direction over an entire unlocking path, and a second spring arrangement, which applies a much greater spring tension than the first spring arrangement. The second spring arrangement also loads the swiveling lever via a spring travel in the opening direction and minimizes the spring travel to maintain the seat of the mounting device with respect to the firearm.

12 Claims, 3 Drawing Sheets

MOUNTING DEVICES FOR FIREARMS AND METHODS OF OPERATING THE SAME

RELATED APPLICATION

This patent is a continuation of International Patent Application Serial No. PCT/EP2005/001653, filed Feb. 17, 2005, which is hereby incorporated herein by reference in its entirety.

FIELD OF DISCLOSURE

This disclosure relates generally to firearms, and, more particularly, to devices for mounting accessories to firearms and methods of operating the same.

BACKGROUND

Typically, accessories are attached to weaponry, such as firearms, to enhance the use of the weapon or the accessibility of the attached accessory. Usually, the accessories are attached to a mounting bracket or rail such as a Picatinny rail, which provides standardized fittings for a variety of accessories. For example, one accessory that is commonly mounted to firearms is a telescopic sight assembly that may be fastened to the underside of an optical or electronic target acquisition device.

One example known mounting device, the so-called "slide mounting," includes two clamps that fasten to the underside of a telescopic sight. The clamps, which engage the lateral edges of a dovetail rail, are movable toward and away from each other and each may be clamped together with a screw. Typically, the clamps are slid upon the rail longitudinally; however, the clamps can also be removed from the rail when the clamps are in an unscrewed state if the screws are long enough. Due to the non-secure attachment of each clamp on the telescopic sight, precise mounting generally cannot be reproduced, meaning that after each time the telescopic sight is placed on the weapon, the alignment fit of the sight has to be tested again.

During World War II, the K 43 German semiautomatic rifle had a telescopic sight that attempted to remedy the above-noted alignment deficiency. In that weapon, two clamps were tightly connected to each other, and a telescopic sight was mounted thereto. In addition, a swiveling lever was mounted on the mounting and was actuated to tighten or loosen the clamping device. Unfortunately, the swiveling lever was quite long, enabling the clamps to be moved over a considerable distance. The loose connection of the clamps made it possible to place the sight on and remove it from the mounting without sliding the sight on the mounting. The swiveling lever worked like a knee lever, so that the spring deflection of the clamps held the swiveling lever tight in its resting position. This arrangement, however, required an adjustment of the clamps because the tolerances would not otherwise permit a reliably tight clamping. Consequently, the mounting was rather bulky, which further necessitated that the mounting be attached to the side of the weapon because the telescopic sight would have been seated too high on the weapon if it were mounted on the top thereof. These disadvantages were experienced with other weapons such as, for example, the Kalashnikov rifles.

In addition, large mountings that have great length not only reduce the marksman's line of vision but also decrease the outer forces that the mounting is able to withstand. However, drastically reducing the size of the mounting also reduces the reliable tolerances and makes it no longer possible to apply the forces necessary for operating the swiveling lever used to tighten or loosen the clamping device.

DETAILED DESCRIPTION

Throughout this description, position designations such as "above," "below," "top" "forward," "rear," etc. are referenced to a firearm held in a normal firing position (i.e., pointed away from the shooter in a generally horizontal direction). Furthermore, the normal firing position of the weapon is always assumed, i.e., the position in which the barrel runs along a horizontal axis and the elevation of the mounting device lies in a vertical plane that contains the barrel axis (for simplicity's sake lateral deviations on the basis of the projectile twist are not taken into consideration here).

In addition, throughout this description, the term "firearm" has a general meaning. The term may refer to, without limitation, general shooting weapons that are suitable for infantry use, hand firearms, large heavy firearms that can only be used with a gun carriage or the like, heavy machine guns, self-loading grenade launchers, etc. This list is not exhaustive.

Disclosed is an example mounting device for use with firearms, onto which the mounting device can be optionally clamped. The clamping of the example mounting device on a firearm is performed by the clamping device, example configurations of which are described herein. For example, in one implementation the clamping device at least includes two clamping jaw arrangements on the mounting device: a rigid clamping jaw arrangement and an oppositely facing movable clamping jaw arrangement. In such an example, the mounting device also includes a swiveling lever having an adjustment and can be used to lock the movable clamping jaw arrangement.

Figure 1:
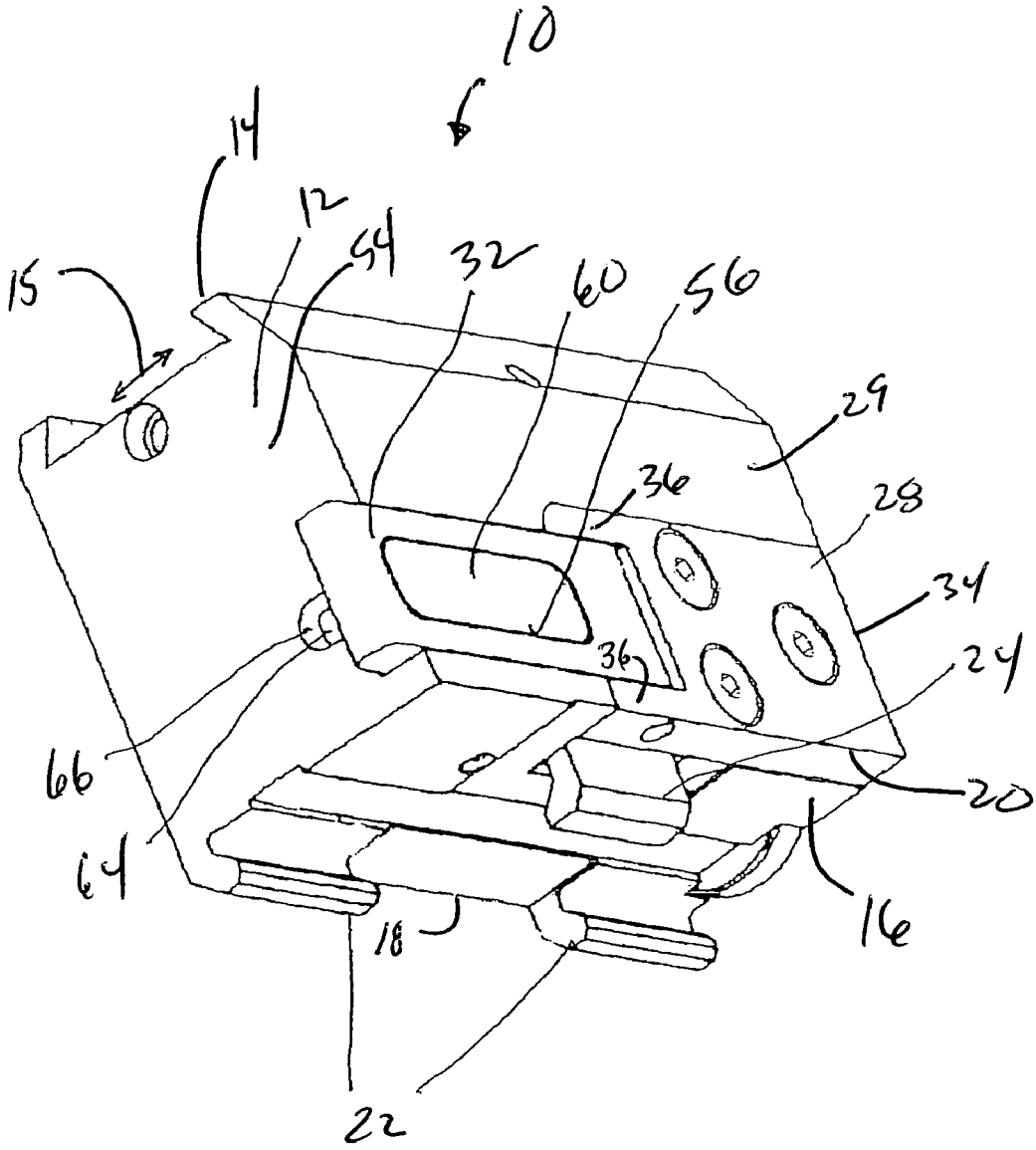
FIG. 1 is an oblique view of an example mounting device.

FIG. 1 shows an oblique view of an example mounting device 10. The example mounting device 10 includes a substantially square- or rectangular-shaped contact block 12 that may be made of a light metal. The block 12 has a longitudinally narrow profile and includes an upper oblong edge 14 and a lower oblong base or edge 16. The base 16 includes a first long lateral edge 18 and a second long lateral edge 20. In one example, the upper edge 14 has a dovetail receptacle 15 for the mounting of an accessory such as, for example, a riflescope or the like. Of course, other receptacle configurations may be used. The base 16 is shaped for mounting on a rail such as, for example, a Picatinny rail. Along the first long lateral edge 18 there is a rigid clamp jaw arrangement 22. In the illustrated example, the rigid clamp jaw arrangement 22 includes two rigid clamp jaws 22, but other numbers of rigid clamp jaws may be used. The base 16 also includes a movable clamp jaw arrangement 24 that oppositely faces the rigid clamp jaws 22 and is seated about in the middle of the base 16 between the lateral edges 18, 20. The movable clamp jaw 24 can be moved toward the fixed clamp jaws 22 to clamp a Picatinny rail therebetween and can also be moved away from the fixed clamp jaws 22 to enable the contact block 12 with the riflescope (or any other device mounted thereto) to be raised up and removed from the Picatinny rail.

The movable clamp jaw 24 may be made of steel and is tightly connected to a piston receptacle 26, which may also be made of steel and is movably guided in the interior of the contact block 12. The rigid clamp jaws 22 may be formed as a single piece integral with the contact block 12 and out of a light metal.

A cover plate 28, which may also be made of steel, is tightly screwed to an exterior side 29 of the contact block 12 near the movable clamp jaw 24. The plate 28 holds the piston receptacle 26 and a vertical swiveling axis 30 around which a swiveling lever 32 swivels in a horizontal plane, as well as other components, which are discussed in further detail below. In one example, the cover plate 28 evenly covers about half of the contact block 12. At one end 34, the cover plate 28 has a substantially vertical edge, and the other end has two protruding flanges 36, one positioned above the other and, between which the swiveling axis 30 extends.

The swiveling lever 32, through which the swiveling axis 30 penetrates, is rotatably coupled to the block 12 between the two flanges 36. As the lever 32 rotates about the axis 30, the swiveling lever 32 forms angles with respect to the contact block 12. The range of motion of the swiveling lever 32 ranges from the resting position (shown in FIG. 2) in which the swiveling lever 32 is turned toward the center of the contact block 12 to an open position (FIG. 3) in which the swiveling lever 32 is horizontally rotated substantially perpendicularly to the contact black 12.

In the resting position, the swiveling lever 32 ends in a locking plane or surface 38 that extends substantially parallel to the swiveling lever 32. At a right angle to the locking plane 38, an opening surface 40 is constructed, forming the end of the swiveling lever 32. The transition between the two surfaces 38, 40 is rounded off and is known as the dead center 39. In addition, the surfaces 38, 40 are not equidistant from the swiveling axis 30. That is, the distance from the opening surface 40 to the swiveling axis 30 is shorter than the distance from the locking plane 38 to the swiveling axis 30. The difference of the distances between each of the two surfaces 38, 40 to the swiveling axis 30 is a bit greater than the maximum movement path, in transverse direction, in which the movable clamp jaw 24 can travel.

Both the locking plane 38 and the opening surface 40 of the swiveling lever 32 act directly on a pin, bolt or piston 42 that is arranged in the interior of the contact block 12. As the swiveling lever 32 is moved, the piston 42 is moved perpendicularly with respect to the swivel axis 30 to and from the exterior of the mounting device 10 within the interior of the contact block 12. The center axis of the piston 42 essentially perpendicularly intersects the swiveling axis 30, and the piston 42 is pushed outward by a first spring arrangement 44 and a second spring arrangement 46. The piston 42 and the first spring arrangement 44 and the second spring arrangement 46 create spring device. In addition, the second spring arrangement provides an adjustment, which is described in more detail below.

When the swiveling lever 32 projects perpendicularly from the exterior surface 20 of the contact block 12 (FIG. 3), then the opening surface 40 is in close contact to the piston 42, and when the swiveling lever 32 is in the resting position engaging the contact block 12 (FIG. 2), then the locking plane 38 is in close contact to the piston 42, which is then further pressed into the contact block 12. When the swivel lever 32 is moved, then the edge between the two surfaces 38, 40, i.e., the dead center 29 is in contact with the piston 42, and at this point, the piston 42 is pressed inward the most.

Figure 2:
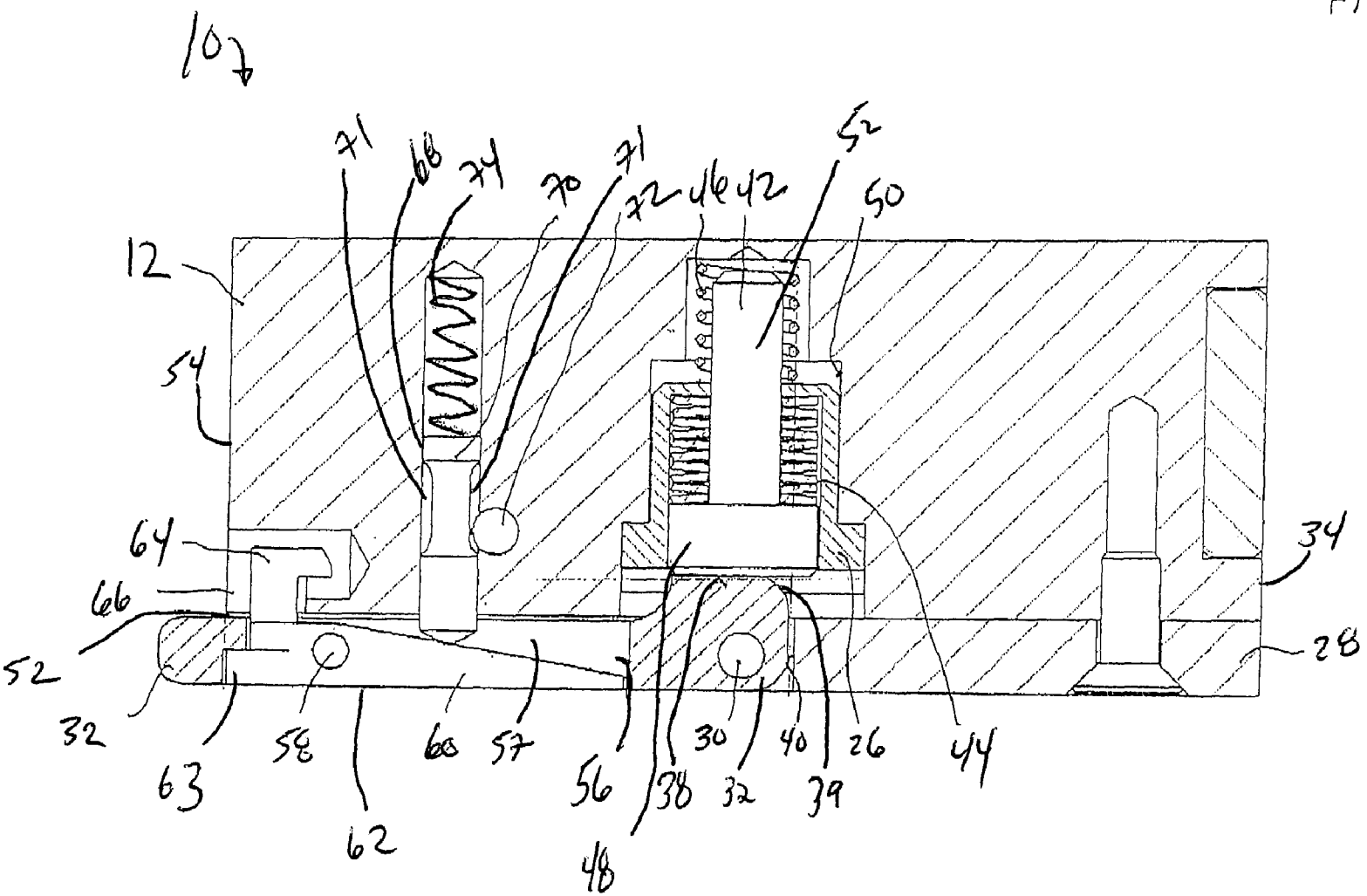
FIG. 2 is a cross-sectional view of the mounting device of FIG. 1 with the swivel lever in a closed position.
Figure 3:
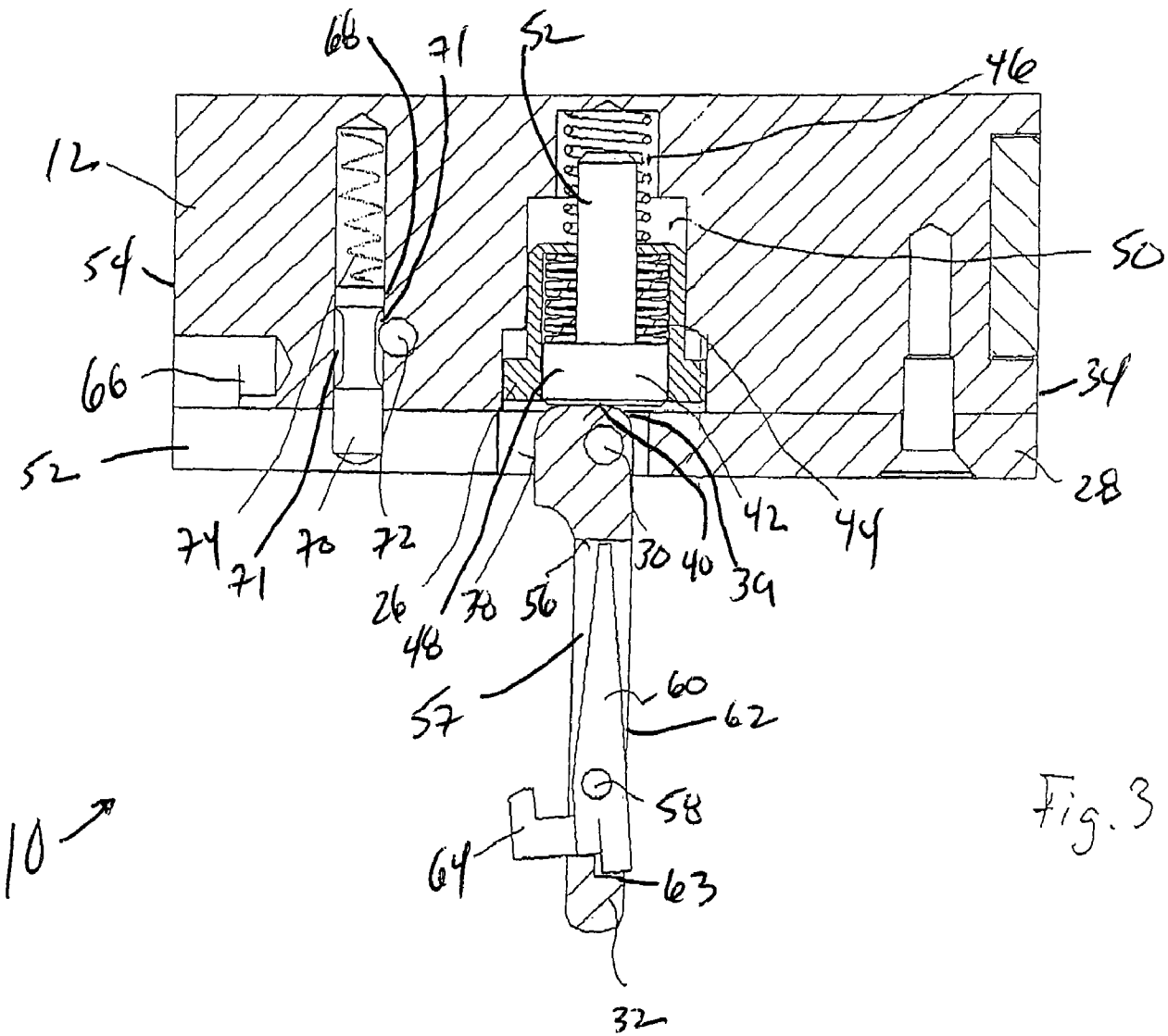
FIG. 3 is a cross-sectional view of the mounting device of FIG. 1 with the swivel lever in an opened position.

The piston 42 has a head 48 upon which the first spring arrangement 44, which may be a Belleville spring washer package 44, is supported. The other end of the Belleville spring washer package 44 rests on the bottom of a bore hole 50 in the piston receptacle 26. The piston 42 also has a shaft 52 that, together with the head 48 run within the bore hole 50, wherein the shaft 52 penetrates the floor of the piston receptacle 26. The second spring arrangement 46, which is a spiral-shaped spring, surrounds the shaft 52 of the piston 42, abuts the outer side of the bottom of the bore hole 50, and rests against the bottom of the bore hole 50, which as shown in FIGS. 2 and 3, is constructed in the contact block 12 and holds the second spring arrangement 46 and piston receptacle 26. The spiral-shaped spring 46 is much weaker than the Belleville spring washer package 44. Please note that in the description of the bore hole 50, "bottom" refers to the direction of the bore hole that is more toward the interior of the contact block 12, i.e., distal to the swiveling lever 32.

The piston receptacle 26 is tightly coupled to the movable clamp jaw 24, as mentioned above. Consequently, as the swivel lever 32 is moved from the resting position (FIG. 2) to the opening position (FIG. 3), the ends 38, 40 of the lever 32 rotate and allow the spiral-spring 46 to push the piston receptacle 26 and the piston 42 outward toward the exterior surface 29. As the piston receptacle 26 moves outward, the movable clamp jaw 24 also moves outward, i.e., away from the rigid clamp jaws 22.

In the open position, the contact block 12 is able to be placed on a Picatinny rail. To close the mounting device 10, the swiveling lever 32 is moved from the opening position (FIG. 3) to the resting position (FIG. 2). As the lever 32 is moved, the piston 42 is moved inward. As the piston 42 is moved inward, the Belleville spring washer package 44 is compressed inward as well. The Belleville spring washer package 44 carries the piston receptacle 26 and, therefore, the movable clamp jaw 24, along until the movable clamp jaw 24 is tightly adjoined to the Picatinny rail. During the closing process, the piston 42 moves further than the movable clamp jaw 24 because the dead center 39 must be passed and the movable clamp jaw 24 must be in forced engagement with the Picatinny rail to provide for a secure grip. Compression of the Belleville spring washer package 44 enables this additional movement path of the piston 42.

While in the resting position (FIG. 2), the swiveling lever 32 lies in a groove 52 of the contact block 12. The swivel lever 32 and the steel plate 28 lie flush with the exterior surface 29 of the contact block. However, the front tip of the swiveling lever 32 projects toward the front over the front surface 54 of the contact block 12.

The arm 57 of the swiveling lever 32 has an oblong, rectangular actuating opening or recess 56 that extends over most of the length of the lever 32. Near the free end or tip of the arm of the lever 32, the horizontally extending recess 56 is penetrated by a vertical hinged door axis 58, which is pounded into the arm 57. A hinged door 60 is pivoted to this hinged door axis 58. The configurations of the hinged door 60 and the recess 56 permit only a slight swiveling movement of the hinged door 60 in which the hinged door 60 is either flush with the outer surface 62 of the swiveling lever 32 (FIG. 2) or is pressed a bit inward (FIG. 3). Close to the tip or free end 63 of the swiveling lever 32, the hinged door 60 has a perpendicularly projecting, horizontal hook 64 that, in the resting position (FIG. 2) engages in a matching hook receptacle 66. Together, the hook 64, the receptacle 66, and the hinged door 60, along with other components described below, form a snap-in device that holds the swiveling lever 32 in the resting position, as described in greater detail below.

The contact block 12 further includes a horizontal, transverse pocket bore hole 68 in which a slider 70 is arranged toward the open end. The slider 70 includes two indentations 71, one of which engages with a vertical pin 72 that extends in the contact block 12. The vertical pin 72 and the associated indentation 71 together only enables the slider 70 to have short movements, e.g., the length of the indentation 71, in the pocket bore hole 68. Note that only one indentation 71 may be used. Between the slider 70 and the bottom of the pocket bore hole 68 a third spring 74, also a spiral spring, is seated. The third spring 74 exerts a force onto the slider 70 and pushes the slider 70 toward the outside as far as the pin 72 permits. The force from the third spring 74 drives the end of the slider 70 out of the pocket bore hole 68 and into the receptacle groove 52. When the lever 32 is in the resting position, the slider 70 extends into the recess 56 opposite the main part of the hinged door 60 on the side of the hinge door axis 58 that does not bear the hook 64. In this position, the slider 70 pushes the hinged door 60 toward the exterior so that the hinged door 60 is flush with the exterior surface 62 of the swiveling lever 32, which causes the door 60 to rotated about the door axis 58 and bring the hook 64 into engagement with the associated receptacle 66.

When the lever is pressed 32 into its resting position, and the first and second spring arrangements 44, 46 are actuated to bring the swiveling lever 32 into the rest position, the hook 64 also slips into its rest position in the receptacle 66 because of the beveled shape of the hook. 64. The hook 64 is thereafter held in the receptacle 66 by the action of the slider 70 on the hinged door 60. If the mounting device 10 is to be removed, then the hinged door 60 is pressed from the outside, which draws the swiveling lever 32 back. Consequently, the thumb and index finger of one hand will suffice to actuate this motion. Once the dead center 39 has been passed, the second spring 46 slides the swiveling lever 32 completely into its open position of FIG. 3.

One of ordinary skill in the art would appreciate that the configuration of the mounting device 10 is less complex than traditional designs while providing many benefits. Some of those benefits include easy operation of the swiveling lever 32, and the ability to guarantee a perfect seat, i.e., a tight fitting on a Picatinny rail or of a telescopic sight to a weapon, etc., without requiring very precise tolerances.

In addition, the mounting device 10 may be very simply and rapidly detached from a weapon or a Picatinny rail. This is beneficial where, for example, a rapid change in location is required but a particularly sensitive device should be removed from the weapon before the location change is performed. With the illustrated example mounting device 10, any such sensitive components mounted thereto can be quickly removed or changed without delaying any necessary location changes. Thus, one of ordinary skill in the art would recognize that application of the illustrated example mounting device 10 within the military would be beneficial.

One of the ways in which these benefits are imparted is that the illustrated example mounting device 10 includes the first spring arrangement 44 that loads the swiveling lever 32 in the opening direction over the entire unlocking path and the second spring arrangement 46 that forms the adjustment, applies a much greater spring tension than the first spring arrangement 44 and loads the swiveling lever 32 via a spring travel in opening direction. With inclusion of the fully loaded second spring arrangement 46, the spring travel is so small that the mounting device 10 does not come away from the firearm, i.e., the second spring arrangement 46 minimizes movement of the mounting device 10 so that the seat of the mounting device with respect to the firearm is tightly maintained while the other side of the mounting device 10 is opened.

When the swivel lever 32 is opened, i.e., when the mounting device 10 is to be opened such as, for example to change an accessory, the first spring arrangement 44 supports the swiveling lever 32 as the lever 32 is swiveled over dead center 39. Thus less tensile force is required to open the swiveling lever 32 when the lever 32 is seated in its resting position in the groove 52 of the contact block 12. Requiring a decreased tensile force means that long handles that project for great distances can be avoided. On the other hand, if the swiveling lever 32 is closed against the force of the first spring arrangement 44, then although an increased compressive force is necessary (compared to the tensile force required to open the lever 32), the increased compressive force can easily be applied because of the illustrated arrangement, i.e., the shape of the swiveling lever 32, the location of the swiveling axis 30, the presence of the piston 42, first spring arrangement 44, second spring arrangement 46, etc.

The second spring arrangement 46 is extremely hard, i.e., has a high spring constant, and the overcoming force is only applied via the last segment of the swiveling movement of the swiveling lever 32 and right before passing the dead center 39. Because the compressive force to overcome the spring force of the second spring arrangement 46 is applied at this point, the force is alleviated after the dead center 39 has been passed. That is, when the head 48 of the piston 42 is in contact with the locking plane 38 or the opening surface 40, the force of the second spring 44 is less than when the lever 32 is in mid-turn causing the dead center 39 to contact the head 48. Consequently, the second spring arrangement 46 acts as an adjustment that powerfully clamps the movable clamping jaw 24 against one point of application on the weapon, which causes the fixed clamping jaws 22 to reliably counter-engage another point of application on the weapon.

In any event, as described above, the spring travel allowed by the second spring arrangement 46 is so small that the mounting device 10 cannot detach from the weapon even if the second spring arrangement 46 is loaded over its entire spring travel. Therefore, for example, if the weapon to which a telescopic sight is coupled via the mounting device 10 falls down a flight of stairs, the integrity of the connection of the mounting device 10 will be maintained.

The illustrated example also provides several other benefits, as described herein, that are readily appreciated by a person of ordinary skill in the art. For example, because the swiveling lever 32 may be loaded more in compression than in tension, the lever 32, as well as the entire mounting device 10 may be shorter. Also, because the second spring arrangement 46 loads the swiveling lever 32 when the dead center 39 is in contact with the 48 of the piston 42, it is more difficult to unintentionally detach the swiveling lever 32. Furthermore, because the second spring arrangement 46 loads the movable clamp jaw 24, no adjustment is necessary to maintain the integrity of the connection of the of the mounting device 10. In addition, as stated above, the small distance of spring travel experienced by the second spring arrangement 46 means that a loss of an accessory or other additional device supported by the mounting device 10 is unlikely, if not impossible, even if the weapon falls.

In a preferred example, the mounting or clamping device 10 is designed in such a way that the clamping jaws 22, 24 can be clamped to a profile rail, which is mounted to a firearm, at the undercuts of the profile rail that extend on both sides in the direction of fire. Here "profile rail" not only refers to a rail that is subsequently mounted to a weapon, such as for example a Picatinny rail, but also to a dovetail profile milled into a weapon, two parallel undercut edges of a weapons case, or the like. Generally, with any of these connections, the rail extends with its longitudinal edges essentially parallel to the longitudinal plateau of the weapon. The profile rail can, thus, for example, be formed by two parallel case edges on top of one another running in the longitudinal direction of the weapon. Generally, however, a Picatinny rail is assumed, which is mounted to the topside of the weapon.

As described above, the illustrated example is also beneficial because the example mounting device 10 includes additional features that secure, to the weapon, the mounting device 10 and, thus, any device such as for example, a telescopic sight, attached thereto, by further securing the swiveling lever 32 in the resting position (FIG. 2). For example, the end of the swivel lever 32 includes the snap-in locking device that includes the hook 64 that fits into the associated receptacle 66 to further secure the swivel lever 32 in the resting position. Therefore, because the swiveling lever 32 includes the hook 64 that holds it in the resting position, the swiveling handle 32 does not have to be positioned and configured so as to avoid accidental operation of the swivel lever 32. However, the lever 32 and hook 64 are also easily detached by the marksmen when desired. In addition, because the swiveling lever 32 has to pass the dead center 39 before transitioning between the resting position and the opening position, without the use of added force, the current state of the swiveling lever 32 is maintained whether that state is locked or not locked. The hook 66, therefore, constitutes a safety.

Though there are many locking devices including those that have snap-in safety features described in the prior art, the illustrated example locking device, as described above, includes the hinged door 60 that is pivotable within the swivel lever 32 and which can be actuated by a marksman to detachably couple the swiveling lever 32 to the mounting device 10. Thus, the swiveling lever does not, as would be required with a small mounting device, have to be fixed to a portion of the weapon or of the profile rail, but rather the swiveling lever 32 in the illustrated example is coupled to the mounting device 10 itself where the swiveling lever 32 may be flush with the exterior surface 29 of the mounting device 10 or otherwise not protrude above the mounting device 10. Thus, the entire mounting device 10 is even more compact so that, for example, it may also be possible to mount two parallel profile rails to one weapon each with their own mounting device.

In an alternative example, the hinged door 60 may be made to include a leaf spring that engages a matching element on the mounting device 10, but which can be detached by the expenditure of force. This would be advantageous for allowing an even smaller design. However, it is preferred that a spring slider, i.e., the third spring arrangement 74 be placed in the mounting device 10. The third spring arrangement 74 is spring-loaded from the outside and acts on a portion of the hinged door 60. Therefore, as described above, then the swiveling lever 32 is in the resting position, the hinged door 60 is pressed into locking engagement. In addition, the third spring arrangement 74 is a relatively large spring, and although the entire mounting device 10 is rather small, the elements that are included therein are not miniaturized, enabling the elements to withstand considerable force and also considerable soiling.

Another advantage of the illustrated example is that the mounting device 10 may be easily unlocked and detached. As described above, the swiveling lever 32 has an actuating opening or recess 56 in which the hinged door 60, particularly the tapered end of the hinged door 60 (FIG. 2) that is spring loaded by the third spring arrangement 74, can be easily accessed and pressed in from the outside of the mounting device 10. Thus, the unlocking of the mounting device 10 is possible practically without additional expenditure of time by the marksman's hand that grasps the swiveling lever 32. In addition, there is little to no danger of unintentionally unlocking the mounting device 10 due to outside actions because the recess 56 can be designed so small that an actuation is possible practically only by the use of a finger tip. When only a finger tip is used to actuate the unlocking of the mounting device 10, the remaining fingers of the same hand grasp the swiveling lever 32 and actuate it, i.e., pull the swiveling lever 32 outward to the opening position perpendicular to the exterior surface 29 of the mounting device 10.

Because the hinged door 60 and, thus, the swiveling lever 32 have to pressed in one direction, i.e., inward to release the hook 66 and be loaded in the opposite direction, i.e., outward to detach the movable clamp jaw 24, accidental release of the mounting device 10 such as, for example, from any external forces experiences from tree branches or other movement or the like, is practically impossible. Therefore, a simple, uncomplicated but highly practical safety is created. Furthermore, due to the large dimensions that are possible for the springs, the load of the material of the mounting device 10 is slight, so that the mounting device 10 can be readily manufactured out of a light metal alloy.

One of ordinary skill in the art would also appreciate that it is advantageous that the mounting device 10 includes the oblong base 16, a first longitudinal edge 18 that includes two rigid clamp jaws 22, and a second longitudinal edge 20, wherein the movable clamp jaw 24 protrudes from the base 16 in the region between the two longitudinal edges 18, 20. Furthermore, though the clamp jaws 22, 24 may be made out of light metal alloy, sufficient surface pressure between the jaws 22, 24 is maintained because of the number of jaws 22, 24. In addition, the movable clamp jaw 24 is centrally located, which leaves sufficient space on all sides for the necessary spring arrangements, though only one spring arrangement is required, not two.

More specifically, the spring device is constructed at a right angle to the longitudinal edges 18, 20. The spring device being formed, as described above, of the piston 42, upon which the first spring arrangement 44 and the second spring arrangement 46 are seated, one above the other. The piston 42, as described above, is also coupled to the movable clamp jaw 24. The piston 42 and the movable clamp jaw 24 form, at least after the mounting, one single component. The swiveling lever 32 acts on the piston 42 and the movable clamp jaw 24 from the outside. In addition, the second spring arrangement 46 may also be formed by one Belleville spring washer package; one that has a high spring constant, i.e., furnishes a very hard springiness. In addition, the first spring arrangement 44 is seated in the piston receptacle 26, which may be a steel sleeve and, thus, prevents overloading of the bore hole 50 in the metallic mounting device 10.

Preferably the mounting device 10 is penetrated near the second longitudinal edge 20 which is closest to the movable clamp jaw 24 by a swivel pin (not shown). The swivel pin can be pivoted around the vertical, swivel axis 30. In addition, the swiveling lever 32 is pivoted to the swivel pin. In this example, the mounting device 10 does not have to be a single piece, but rather can, for example, preferably include the steel plate 43 in which the swiveling lever 32 is pivoted and which is laterally screwed onto the light metal contact block 12.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A mounting device for use with a firearm wherein the mounting device includes a clamping device, with which the mounting device can be optionally clamped to the firearm, wherein the clamping device comprises:

a rigid clamping jaw arrangement;

a movable clamping jaw arrangement opposite the rigid clamping jaw arrangement; and a swiveling lever, wherein the swiveling lever is coupled to a spring device that locks the movable clamping jaw arrangement, wherein the spring device comprises:

a first spring arrangement, which loads the swiveling lever in an opening direction over an entire unlocking path; and a second spring arrangement, which applies a much greater spring tension than the first spring arrangement and loads the swiveling lever via a spring travel in the opening direction, and minimizes the spring travel to maintain the seat of the mounting device with respect to the firearm.

2. The mounting device as defined in claim 1, wherein a profile rail is mounted to the firearm, the profile rail includes a first undercut and a second undercut, the first and second undercuts extend in the direction of fire, and the mounting device may be coupled thereto.

3. The mounting device as defined in claim 1, further including a snap-in locking device, wherein the snap-in locking device holds the swiveling lever in a resting position.

4. The mounting device as defined in claim 3, wherein the snap-in locking device comprises a hinged door that is pivotable within the swiveling lever, wherein the hinged door detachably fixes the swiveling lever to the mounting.

5. The mounting device as defined in claim 4, further comprising a slider that is placed in the mounting device, wherein the slider is spring-loaded from the outside and acts on a flange of the hinged door so that in the resting position of the swiveling lever the hinged door is pressed into locking engagement.

6. The mounting device as defined in claim 5, wherein the swiveling lever has a continuous recess in which the spring-loaded flange of the hinged door is seated and which can be pressed in from the outside.

7. The mounting device as defined in claim 1, further comprising an oblong base with a first longitudinal edge and a second longitudinal edge, wherein the second longitudinal edge opposes the first longitudinal edge, the rigid clamp jaw arrangement is seated along the first longitudinal edge, and the movable clamp jaw arrangement is seat in a region in the middle of the first longitudinal edge and the second longitudinal edge.

8. The mounting device as defined in claim 7, wherein the spring device is placed at a right angle to the first and second longitudinal edges, and the spring device further comprises a piston that is coupled to the movable clamp jaw arrangement and upon which the first spring arrangement and the second spring arrangement are seated.

9. The mounting device as defined in claim 1, further comprising a swivel pin, wherein the swivel pin penetrates the mounting device near the second longitudinal edge and is pivotable around a vertical axis, and wherein to which the swiveling lever is pivoted.

10. A method of attaching an accessory to a mounting device on a firearm, wherein the mounting device includes a swiveling lever, a piston, a first spring arrangement, a rigid clamping jaw arrangement and a movable clamping jaw arrangement positioned opposite the rigid jaw arrangement, the method including:

providing a tensile force to the swiveling lever to open the lever, wherein movement of the swiveling lever causes the piston to initially compress the first spring arrangement followed a movement of the first spring arrangement and the piston toward the exterior of the mounting device which causes the movable clamping jaw arrangement to move away from the rigid clamping jaw arrangement;

placing an accessory between the rigid jaw arrangement and the movable jaw arrangement; and providing a compressive force to the swiveling lever to close the lever, wherein of the swiveling lever causes the piston to compress the first spring arrangement which causes the movable clamping jaw arrangement to move toward the rigid clamping jaw arrangement and hold the accessory therebetween.

11. A method a described in claim 10, wherein the mounting device further comprises a snap-in safety device that includes an hinged door, a hook and a receptacle in which the hook is arranged when the mounting device is in a locked position, the method further comprising:

prior to the providing of a tensile force, providing a force to the hinged door to cause the hook to disengage the receptacle; and subsequent to the providing of the compressive force, providing a force to cause the hook to engage the receptacle.

12. A method as described in claim 11, wherein the mounting device further includes a second spring arrangement and a slider wherein the second spring arrangement causes to the slider to act on the hinged door to keep the hinged door in the resting position, wherein the method further includes: while providing a force to the hinged door to cause the hook to disengage the receptacle, causing the slider to retract into the mounting device against the force of the second spring arrangement.

* * * * *